United States Patent [19]

Jones

[11] Patent Number: 4,483,449

[45] Date of Patent: Nov. 20, 1984

[54] TAMPER-RESISTANT VIAL

[76] Inventor: Marcus C. Jones, 7009 Stoney Creek, Oklahoma City, Okla. 73132

[21] Appl. No.: 456,604

[22] Filed: Jan. 10, 1983

[51] Int. Cl.[3] ..... B65D 55/02

[52] U.S. Cl. ..... 215/250; 215/203; 220/265; 206/807

[58] Field of Search ..... 215/209, 203, 211, 216, 215/250, 251, 252, 253, 294, 296; 220/260, 258, 256, 20, 23, 265, 266, 272; 206/807

[56] References Cited

U.S. PATENT DOCUMENTS

| | | | |
|---|---|---|---|
| 1,431,998 | 10/1922 | Voglmayer | 215/296 X |
| 2,387,978 | 10/1945 | Casey | 220/23 X |
| 2,540,846 | 2/1951 | Thompson | 220/20 X |
| 3,838,785 | 10/1974 | Lancesseur | 215/251 |
| 3,951,331 | 4/1976 | Smith et al. | 215/253 X |
| 4,059,201 | 11/1977 | Foster | 220/258 |

FOREIGN PATENT DOCUMENTS

| | | | |
|---|---|---|---|
| 2107290 | 4/1983 | United Kingdom | 215/203 |

*Primary Examiner*—Allan N. Shoap
*Assistant Examiner*—Bryon Gehman
*Attorney, Agent, or Firm*—Bill D. McCarthy

[57] ABSTRACT

A substantial tamper-resistant vial for pharmaceutical compounds and the like comprising a detachable disc insert assembly disposable within the dispensing opening of the vial and a connector member secured to the detachable disc insert assembly, the disc insert assembly and the connector member cooperating such that upon removal of the disc insert assembly an indicator signal is provided to inform a person that the detachable disc insert assembly has previously been removed.

21 Claims, 9 Drawing Figures

TAMPER-RESISTANT VIAL

BACKGROUND OF THE INVENTION

1. Field of the Invention

The present invention relates to vials, and more particularly, not by way of limitation to an improved tamper-resistant vial for the storing and dispensing of tablets, capsules and the like.

2. Description of the Prior Art

Vials have been known and employed in the pharmaceutical industry for the storage and marketing of pharmaceutical compounds in the form of tablets, capsules, liquids and powders. In recent years efforts have been made to improve safety features of vials containing pharmaceutical compounds marketed to the public, such as the so called "child-resistant" or "child-proof" closure assemblies, to prevent undesirable and unauthorized access to the contents contained in the vials by small children. Such vials and closure assemblies have generally met with success. However, recently problems have been encountered in that generic pharmaceutical compounds offered over-the-counter in drug stores, supermarkets and the like have been tampered with by persons injecting foreign substances into the capsules contained in the vials. This tampering has not only resulted in death to persons unknowingly purchasing such tampered products, but has created a great concern in the minds of the public as to the safety of such non-prescription pharmaceutical compounds. Therefore, a need has arisen for providing a substantially tamper-resistant closure assembly for a vial containing non-prescription pharmaceutical compounds, such as tablets, capsules and the like so that the buying public can be assured that the contents in the vial have not been tampered with, or that, if tampered with, will readily warn the public without undesirable ingestion of the contents of the vial.

SUMMARY OF THE INVENTION

The present invention relates to a substantially tamper-resistant vial for storage and marketing generic pharmaceutical compounds such as tablets, capsules and the like. In one aspect, the present invention relates to a vial having a dispensing opening formed therein, a detachable disc insert assembly disposable within the dispensing opening such as to permit a vial closure member to be secured to the vial to seal off the dispensing opening, and a connector member secured to the detachable disc insert assembly, the connector member and the detachable disc insert assembly cooperating such that upon removal of the disc insert assembly from the vial at least a portion of the connector member provides an indicator signal that the disc insert assembly has been previously removed and/or tampered with.

An object of the present invention is to provide a substantially tamper-resistant vial for pharmaceutical compounds to restrict undesirable and unauthorized tampering of the pharmaceutical compounds contained within the vial.

Another object of the present invention is to provide a vial which, upon inspection, readily informs the purchaser of a potential tampering of the pharmaceutical goods contained within the vial.

Another object of the present invention to to provide a pharmaceutical dispensing vial having a substantially tamper-resistant mechanism that does not unduly restrict the dispensing of the pharmaceutical goods from the vial for use of such goods by the purchaser.

Still another object of the present invention is to provide a tamper-resistant enclosure assembly for use with commercially available medical vials which requires limited modification of the vial and which is economical to manufacture.

Other objects, features and advantages of the present invention will become clear upon reading the following detailed description in conjunction with the drawings and the appended claims.

BRIEF DESCRIPTION OF THE DRAWINGS

FIG. 4 is an isometric view of a detachable disc insert assembly of the tamper-resistant enclosure assembly of the present invention and illustrating an enlarged break away tip portion of a stem element contained within the disc insert assembly for providing an indicator signal that the detachable disc insert assembly has been previously removed or tampered with.

DESCRIPTION

Figure 1:
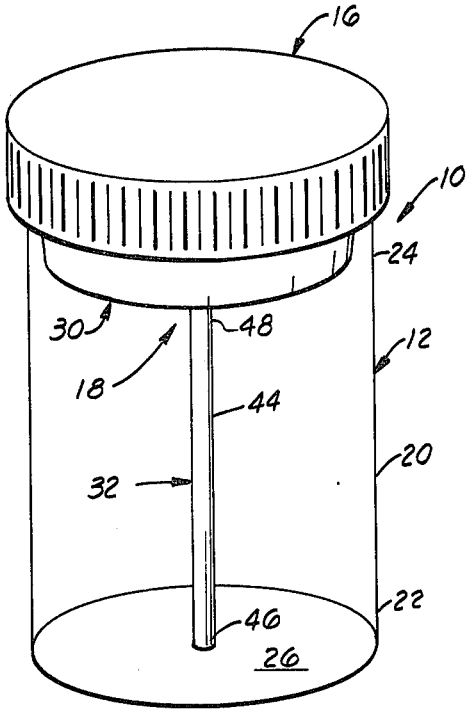
FIG. 1 is an isometric view of a substantially tamper-resistant vial constructed in accordance with the present invention, the vial having a closure member secured thereto for closing off the dispensing opening of the vial.
Figure 2:
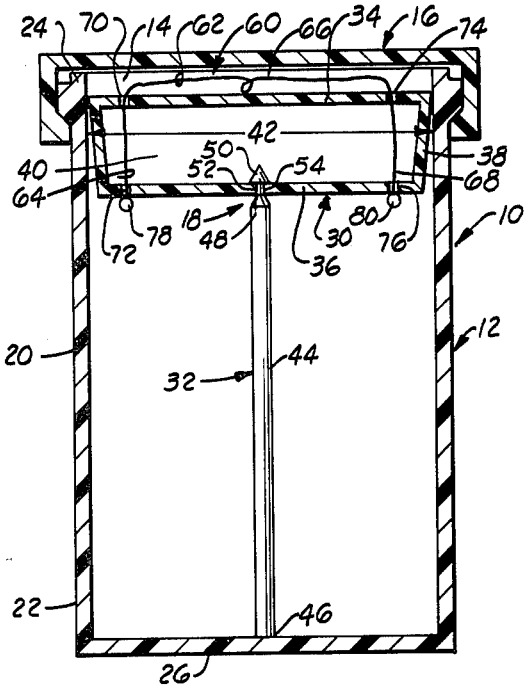
FIG. 2 is a partial cut away elevational of the substantially tamper-resistant vial of the present invention.

Referring to the drawings, and more particularly to FIGS. 1 and 2, shown therein is a substantially tamper-resistant container 10 constructed in accordance with the present invention. The tamper-resistant container 10 comprises a vial 12 having a dispensing opening 14 (see FIG. 2) formed therein, a cap member 16 connectable to the vial 12 for closing off the dispensing opening 14 when desired, and a substantially tamper-resistant enclosure assembly 18 disposed within the dispensing opening 14 for restricting access to the contents of the vial 12 so as to substantially prevent tampering with the contents contained in the vial 12.

The vial 12 can be constructed of any suitable material, such as plastic, glass and the like; and the vial 12 may be constructed a variety of shapes. For example, the vial 12 illustrated in the drawings is cylindrical in shape and comprises a side portion 20 having a lower end portion 22 and an upper end portion 24. A bottom plate 26 is secured to the lower end portion 22. The upper portion 24 of the side portion 20 defines the dispensing opening 14. The cap member 16 is securable to the upper portion 24 of the side portion 20 by any suitable means known in the art. Thus, the vial 12 and the cap member 16 are of conventional construction except for portions of the vial 12 which may be modified to support certain elements of the tamper-resistant enclosure assembly 18 as will be more fully described hereinafter.

The tamper-resistant enclosure assembly 18 comprises a detachable insert disc 30 and a connector element 32. The detachable insert disc 30 is positionable within the dispensing opening 14 of the vial 12 such that the cap member 16 can be secured thereto as illustrated in FIGS. 1 and 2. The connector element 32, which may be formed as an integral part of the vial 12 or as a separate element, secures the detachable insert disc 30 within the dispensing opening 14 of the vial 12 to restrict access to the contents within the vial 12 without first removing the detachable insert disc 30. The connector element 32 is constructed and connected to the detachable insert disc 30 such that upon removal of the detachable insert disc 30 from the dispensing opening 14 of the vial 12 an indicator signal, such as a visual or audio signal, will thereafter be provided so that a person can be informed that the detachable insert disc 30 has previously been removed from the vial 12.

Figure 4:
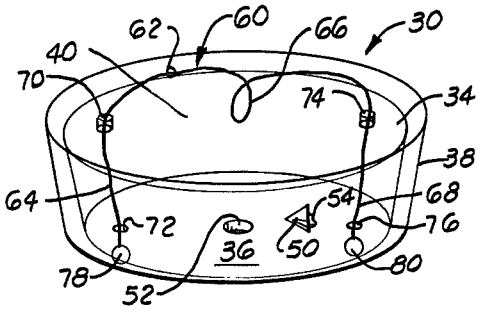
Figure 5:
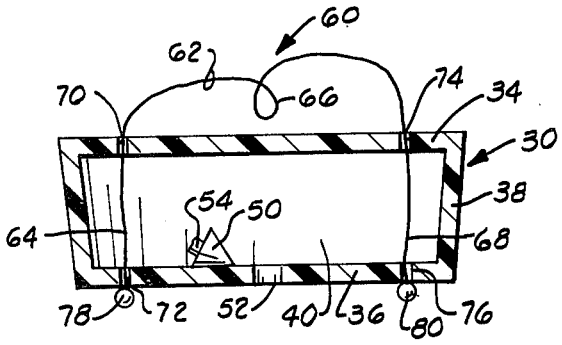
FIG. 5 is a cross sectional view of the detachable disc insert assembly of the tamper-resistant enclosure assembly of the present invention also illustrating an enlarged break away tip portion of a stem element in a detached position as a result of removal of the detachable disc insert assembly from the vial.

Referring now to FIGS. 2, 4 and 5, the detachable insert disc 30 is illustrated as a substantially cylindrical member comprising an upper disc shaped member 34, a spatially disposed lower disc shaped member 36, and a side member 38 interconnecting the upper and lower disc shaped member 34, 36 so as to provide a cavity 40 therebetween. The upper disc shaped member 34 is provided with a circumference substantially corresponding to the inside diameter 42 of the dispensing opening 14 of the vial 12, and the lower disc shaped member 36 is provided with a circumference less than the inside diameter 42 of the dispensing opening 14. Thus, the interconnection of the upper disc shaped member 34 to the lower disc shaped member 36 via the side member 38 provides the disc 30 with a tapered side portion substantially as shown. By constructing the detachable insert disc 30 as recited above placement of the insertable disc 30 into the dispensing opening 14 of the vial 12 by the manufacturer, or a subsequent user, if desired, is substantially enhanced.

Figure 7A:
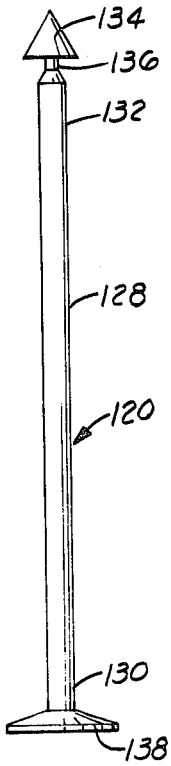
FIG. 7A is an elevational view of one embodiment of a stem element of the tamper-resistant enclosure assembly constructed in accordance with the present invention.
Figure 7B:
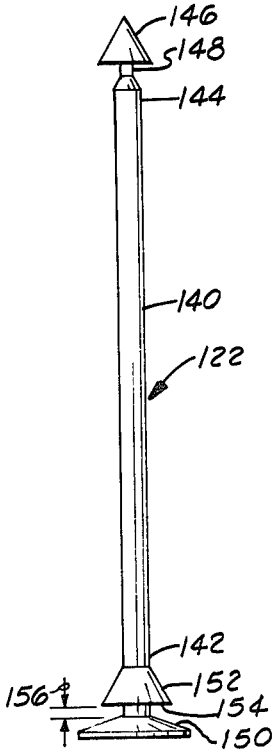
FIG. 7B is another embodiment of a stem element of the tamper-resistant enclosure assembly constructed in accordance with the present invention.
Figure 7C:
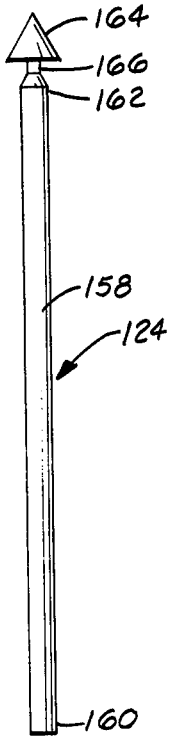
FIG. 7C is yet another embodiment of a stem element of the tamper-resistant enclosure assembly constructed in accordance with the present invention.

The connector element 32, which secures the detachable insert disc 30 within the dispensing opening 14 of the vial 12, can be formed as an integral portion of the vial 12 (as illustrated in FIGS. 1 and 2) or as separate element (as illustrated in FIGS. 7A, 7B and 7C). As shown in FIGS. 1 and 2 the connector element 32 comprises a stem or body portion 44 having a first end portion 46 and an opposed second end portion 48. In this embodiment the connector member 32 is formed as an integral portion of the vial 12. Therefore, the first end portion 46 of the stem 44 is connected to and formed on the bottom plate 26 of the vial 12 such that the stem 44 extends substantially perpendicular from the planar surface of the bottom plate 26 as shown. The opposed second end portion 48 of the stem 46 is connected to the lower disc shaped member 36 of the detachable insert disc 30 by any suitable means such that upon removal of the detachable insert disc 30 from the dispensing opening 14 of the vial 12 a signal, whether visual or audio, is provided to inform the person that the detachable insert disc 30 has previously been removed. One suitable means for connecting the opposed second end portion 46 of the stem 44 to the lower disc shaped member 36 of the detachable insert disc 30 is to provide the opposed second end portion 46 of the stem 44 with an enlarged break away tip portion 50. The enlarged break away tip portion 50 is provided with a substantially conical shaped tip positionable through an aperture 52 in the lower disc shaped member 36 of the detachable insert disc 30 substantially as shown in FIG. 2. The enlarged break away tip portion 50 is secured or formed on the opposed second end portion 48 of the stem 44 by any suitable means, such as a reduced throat portion 54 so that once the enlarged break away tip portion 50 has been positioned through the aperture 52 of the lower disc shaped member 36 application of an upwardly directed pressure will cause the enlarged break away tip portion 50 to separate from the opposed second end portion 48 of the stem 44. The separated enlarged break away tip portion 50 of the connector element 32 will thus be contained within the cavity 40 of the detachable insert disc 30 such that a person can readily determine, either by visual inspection or by sound resulting from the movement of the break away tip portion 50 within the cavity 40 upon shaking of the vial 12 that the detachable insert disc 30 has either been previously removed or has been tampered with. The detached break away tip portion 50 positioned within the cavity 40 of the detachable insert disc 30 is illustrated in FIGS. 4 and 5 of the drawings.

To assist in the removal of the detachable insert disc 30 from the dispensing opening 14 of the vial 12 the tamper-resistant enclosure assembly 18 of the present invention further comprises a disc removal assembly 60 secured to the detachable insert disc 30 such that upon application of a pulling motion to the disc removal assembly 60 the detachable insert disc 30 can be removed from the dispensing opening 14 of the vial 12. Any suitable means can be employed as the disc removal assembly 60 of the present invention. However, it is necessary that the disc removal assembly 60 be constructed and designed to withstand having sufficient force exerted upon it to separate the enlarged break away tip portion 50 from the stem 44 of the connector element 32 when it is desirable to remove the detachable insert disc 30 from the vial 12.

The disc removal assembly 60 comprises a strap 62 having a first end portion 64, a medial portion 66, and a second end portion 68. The first and second end portions 64, 68 of the strap 62 are secured to the detachable insert disc 30 by any suitable means such that upon application of pressure via a pulling motion to the medial portion 66 of the strap 62 the detachable insert disc 30 can be removed from the dispensing opening 14 of the vial 12. For examples, the upper disc shaped member 34 and the lower disc shaped member 36 of the detachable insert disc 30 can each be provided with aligned apertures 70, 72 in a first portion thereof, and aligned apertures 74, 76 in a second portion thereof substantially as shown. The first end portion 64 of the strap 62 is disposed through the aligned aperture 70, 72 of the upper and lower disc shaped members 34, 36 and secured thereto by any suitable means, such as by providing an enlarged portion 78 on the first end portion 64 of the strap 62 disposed through the aperture 72 of the lower disc shaped member 34. Similarly, the second end portion 68 of the strap 62 is disposed through the aligned apertures 74, 76 of the upper and lower disc shaped members 34, 36 and secured thereto by any suitable means, such as providing an enlarged portion 80 on the second end portion 68 of the strap 62 disposed through the aperture 76 of the lower disc shaped member 34. In securing the first and second end portions 64, 68 to the upper and lower disc shaped members 34, 36 care must be exercised to insure that a sufficient amount of the strap member 62 forming the medial portion 66 is disposed above the upper disc shaped member 34 to enable a person to grasp hold of the medial portion 66 for exerting the necessary force to remove the detachable insert disc 30. Further, when employing the strap 62 as described above as the disc removal assembly 60, the enlarged portions 78, 80 formed on the first and second end portions 64, 68 of the strap 62 must be of sufficient size to prevent the first and second end portions 64, 68 of the strap 62 from being pulled through the before-mentioned aligned apertures contained in the upper and lower disc shaped members 34, 36 when pulling pressure is applied to the strap 62 via the medial portion 66 thereof.

Figure 6:
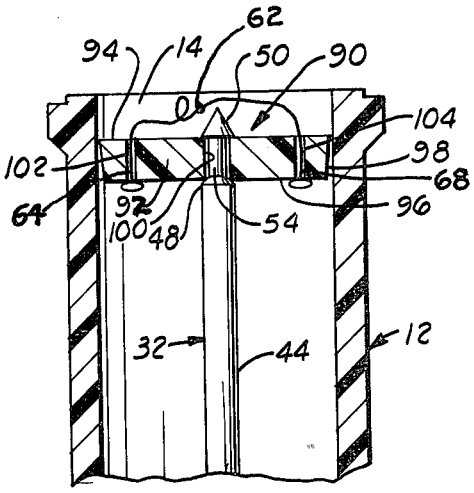
FIG. 6 is a partial cutaway elevational view of another embodiment of a disc insert positioned within a dispensing opening of a vial and illustrating an enlarged break away tip portion of a stem element of the tamper-resistant enclosure assembly of the present invention in a connected position with the disc insert.

Referring now to FIG. 6 a second embodiment of a detachable disc insert assembly 90 is illustrated. The detachable insert disc 90 comprises a disc shaped member 92 having an upper side 94, opposed lower side 96 and a tapered side portion 98, at least an upper portion of the tapered side portion 98 having a configuration substantially corresponding to the shape of the dispensing opening 14 formed in the vial 12. An aperture 100 is centrally disposed within the disc member 92 and extends between the upper side 94 and the lower side 96 thereof, the aperture 100 being adapted to receive the enlarged break away tip portion 50 of the stem or body portion 44 of the connector element 32 in the same manner as heretofore described with reference to the lower disc shaped member 36 of the detachable insert disc 30. The disc member 92 is further provided with a pair of spatially disposed apertures 102, 104 adapted to receive the first and second end portions 64, 68 of the strap 62 such that the first and second end portions 64, 68 thereof can be secured thereto in the same manner as heretofore described with reference to the attachment of the strap 62 to the detachable insert disc 30.

As previously stated, the connector element of the enclosure assembly of the present invention can be formed as an integral part of the vial 12 (such as the connector assembly 32 illustrated in FIGS. 1 and 2), or the connector element can be fabricated as a separate element for attachment to a vial.

Figure 3:
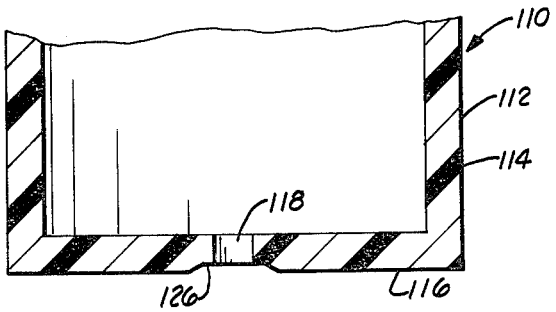
FIG. 3 is a cut away view of a lower portion of a vial illustrating an opening therein for receiving a stem element of the tamper-resistant enclosure assembly of the present invention.

Referring now to FIG. 3, a portion of a modified vial 110 is illustrated. The vial 110 may be constructed of any suitable material and shape. For example, the modified vial 110 illustrated in the drawing is formed of a plastic material and is provided with a cylindrical shape. The modified vial comprises a side portion 112 having an upper end portion (not shown), defining a dispensing opening, and a lower end portion 114. A bottom plate 116 is secured to the lower end portion 114. The vial 110 is substantially identical in construction to the vial 12 heretofore described with the exception of bottom plate 116.

The bottom plate 116 of the vial 110 is provided with an aperture 118 therein for receiving a connector element, such as a connector element 120, 122 or 124 illustrated in FIGS. 7A, 7B and 7C, respectively. The bottom plate 116 of the vial 110 can also be provided with a recessed portion 126 to insure that when one of the connector elements 120, 122, or 124 has been secured in the bottom plate 116 via the aperture 118, the vial 110 can be maintained in a stable standing position.

Referring now to FIG. 7A the connector element 120 comprises a stem or body portion 128 having a first end portion 130 and an opposed second end portion 132. An enlarged break away tip portion 134 is formed on the opposed second end 132 of the stem 128 such that the enlarged break away tip portion is positionable through an aperture in the attachable insert disc, such as the aperture 52 of the detachable insert disc 30 heretofore described. To assist in the breaking off of the enlarged head portion 134 for removal of the detachable insert disc, such as insert discs 30 or 90, a reduced throat portion 136 can be formed on the opposed second end portion 132 of the stem 128 as shown. A base member 138 is connected to the first end portion 130 of the stem 128 such that upon positioning the stem 128 into the vial 110 via the aperture 118, the base member 138 is disposed within the recess portion 126 formed in the bottom plate 116 of the vial 110. The base member 138, and thus the first end 130 of the stem 128, can be secured within the recessed portion 126 and the aperture 118 of the bottom plate 116 of the vial 110 by any suitable means such as by heat sealing, adhesives or the like.

Referring now to FIG. 7B the connector element 122 comprises a stem or body portion 140 having a first end 142 and an opposed second end 144. An enlarged break away tip portion 146 is formed on the opposed second end 144 of the stem 140 such that the enlarged break away tip portion is positionable through an aperture formed in the detachable insert disc, such as the aperture 52 of the detachable insert disc 30 heretofore described. To assist in the breaking off of the enlarged tip portion 146 for removal of the detachable insert disc, such as insert discs 30 or 90, a reduced throat portion 148 can be formed on the opposed second end portion 144 of the stem 140 substantially as shown. A base member 150 is formed or connected to the first end portion 142 of the stem 140 such that upon positioning the stem 140 into the vial 110 via the aperture 118, the base member 150 is disposed within the recessed portion 126 formed in the bottom plate 116 of the vial 110. The base member 150, and thus the first end 142 of the stem 140, can be secured within the recessed portion 126 and the aperture 118 of the bottom plate 116 of the vial 110 by any suitable means.

The connector element 122 further comprises a conical shaped flexible member 152. The conical shaped flexible member 152 is connected or formed on the stem 140 such that a lower portion 154 of the conical shaped member 152 is disposed a distance 156 from the base member 150. The distance 156 substantially corresponds to the thickness of the portion of the bottom plate 116 of the vial 110 surrounding the aperture 118. The conical shaped member 152 is formed of a flexible material such that the conical shaped member 150 can be compressed and inserted through the aperture 118 of the bottom plate 116, and once through the aperture 118, the conical shaped flexible member 152 expands to its normal size and shape and thus substantially covers the aperture 118.

The connector element 124 illustrated in FIG. 7C comprises a stem or body portion 158 having a first end 160 and an opposed second end 162. An enlarged break away tip portion 164 is formed on the opposed second end 162 of the stem 158 such that the enlarged head portion 164 is positionable through an aperture in the detachable insert disc, such as the aperture 52 of the lower disc shaped member 36 of the detachable insert disc 30 heretofore described. The first end portion 160 of the stem 158 is positionable within the aperture 118 of the bottom plate 16 of the vial 110 and secured thereto by any suitable means, such as heat sealing, adhesive or the like. To assist in the breaking off of the enlarged head portion 164 for removal of the detachable insert disc such as insert discs 30 or 90, a reduced throat portion 166 can be formed on the opposed second end portion 162 of the stem 158 substantially as shown.

The unique construction and interconnection of the tamper-resistant enclosure assembly of the present invention, inluding the detachable insert disc, the connector element, and their relationship with a vial provides for the construction of a vial which is substantially tamper-resistant or in the alternative enables a potential purchaser to readily determine if the vial and thus the contents therein have been tampered with. Thus, it is clear that the present invention is well adapted to carry out the objects and attain the ends and advantages mentioned as well as those inherent therein. While presently preferred embodiments of the invention have been described for purposes of this disclosure numerous changes may be made which will readily suggest themselves to those skilled in the art and which are encompassed within the spirit of the invention disclosed and as defined in the appended claim.

Having thus described the invention, I claim:

1. A tamper-resistant enclosure assembly for a container having a dispensing opening formed therein, the container adapted to receive a cap member for closing the opening, the enclosure assembly comprising:

detachable disc insert means positionable within the dispensing opening for substantially sealing the container such that the cap member can be secured to the container;

disc removal means secured to the detachable disc insert means for allowing removal of the disc insert means from the dispensing opening in the container; and connector means for securing the detachable disc insert means within the dispensing opening of the container, the connector means and detachable disc insert means cooperating such that upon removal of the disc insert means from the opening of the container an indicator signal is provided to inform a person that the detachable disc insert means has previously been removed, the connector means comprising a stem element having a first end portion and an opposed second end portion, connected to the container such that the opposed second end portion is detachably connected to the detachable disc insert means.

2. The tamper-resistant enclosure assembly of claim 1 wherein the stem element is formed as an integral part of the container.

3. The tamper-resistant enclosure assembly of claim 1 wherein the detachable disc insert means is provided with an aperture therein and wherein the connector means further comprises an enlarged break away tip portion formed on the opposed second end of the stem element, the top portion positionable through the aperture in the detachable disc insert means such that upon removal of the disc insert means from the opening in the container the top portion is removed from the stem member.

4. The tamper-resistant enclosure assembly of claim 3 wherein the opposed second end of the stem element is provided with a reduced throat portion disposed adjacent the enlarged break away tip portion.

5. The tamper-resistant enclosure assembly of claim 3 wherein the container is provided with an aperture therein adapted to receive the first end portion of the stem member, and wherein the connected means further comprises a base member connected to the first end portion of the stem member such that upon positioning the stem member into the container via the aperature in the container the base member is disposed substantially adjacent a portion of the container defining the aperture therein.

6. An improved tamper-resistant enclosure assembly for a container having a cap member for closing a dispensing opening of the container, the tamper-proof enclosure assembly comprising:

cylinder means positionable within the dispensing opening of the container for substantially sealing the dispensing opening, the cylinder means characterized as having an upper member, a spatially disposed lower member and a side member interconnecting the upper and lower members so as to provide a cavity therebetween, the upper member of the cyllinder means provided with a circumference substantially corresponding to the inside diameter of the dispensing opening in the container and the lower member of the cylinder means provided with a circumference less than the inside diameter of the dispensing opening such that the side member is tapered;

connector means for securing the cylinder means within the opening of the container such that once the cylinder means is removed from the opening of the container an indicator signals a person that the cylinder means has been previously removed; and cylinder removal means secured to the cylinder means for disengaging the connector means from the cylinder means and permitting removal of the cylinder means from the opening of the the container for access to the contents of the container, the connector means comprising a stem element having a first end portion and an opposed second end portion, the first end portion connectable to the container such that the second end portion is connected to the lower member of the cylinder means such that upon application of a pulling motion to the cylinder removal means the opposed second end portion of the stem element breaks away from the remainder of the stem element to provide the indicator signal.

7. The improved tamper-resistant enclosure assembly of claim 6 wherein the lower member of the cylinder means is provided with an aperture therein, and wherein the opposed second end portion of the stem member comprises an enlarged, substantially conical shaped tip portion positionable through the aperture of the lower member of the cylinder means such that upon removal of the cylinder means from the dispensing opening of the container the tip portion of the stem member breaks away from the remainder of the stem and is contained within the cylindrical means.

8. The improved tamper-resistant enclosure assembly of claim 7 wherein the container is provided with an aperture in a portion thereof substantially opposed to the dispensing opening, the aperture adapted to have the stem member positioned therethrough, and wherein the first end portion of the stem member comprises a base member having a diameter greater than the diameter of the aperture in the container such that in an assembled position the base member of the stem abutts the portion of the container defining the aperture therein.

9. The improved tamper-resistant enclosure assembly of claim 7 wherein the stem element is formed as an integral part of the container, and wherein the opposed second end portion of the stem element is provided with reduced throat means disposed adjacent the conical shaped tip portion for assisting in removal of the conical shaped tip portion for removal of the cylinder means from the dispensing opening in the container.

10. An improved tamper-resistant enclosure assembly for a container having a cap member for closing a dispensing opening of the container, the tamper-proof enclosure assembly comprising:

cylinder means positionable within the dispensing opening of the container for substantially sealing the dispensing opening, the cylinder means characterized as having an upper member, a spatially disposed lower member and a side member interconnecting the upper and lower members so as to provide a cavity therebetween, the cylinder means provided with a circumference substantially corresponding to the inside diameter of the dispensing opening in the container, and the lower member provided with a circumference less than the inside diameter of the dispensing opening such that the side member is tapered, the lower member is further provided with an aperture therein; and connector means for securing the cylinder means within the opening of the container such that once the cylinder means is removed from the opening of the container an indicator signals a person that the cylinder means has been previously removed, the connector means comprising a stem element formed as an integral part of the container and having a first end portion and an opposed second end portion, the first end portion connected to the container such that the second end portion is connected to the lower member of the cylinder means, the opposed second end portion of the stem member comprising an enlarged, substantially conical shaped tip portion positionable through the aperture of the lower member of the cylinder means such that upon removal of the cylinder means from the dispensing opening of the container the tip portion of the stem member breaks away from the remainder of the stem and is contained within the cylindrical means; and cylinder removal means secured to the cylinder means for disengaging the connector means from the cylinder means and permitting removal of the cylinder means from the opening of the container for access to the contents of the container, the application of a pulling motion to the cylinder removal means causing the opposed second end portion of the stem element to break away from the remainder of the stem element to provide the indicator signal.

11. The improved tamper-resistant enclosure assembly of claim 10 wherein the cylinder removal means comprises a strap having a first end portion, an opposed second end portion and a medial portion, the first and second end portions being connected to one of the upper and lower members of the cylinder means such that the medial portion of the strap is disposed above the upper member.

12. The improved tamper-resistant enclosure assembly of claim 11 wherein the upper and lower members of the cylinder means comprise a pair of aligned apertures therein, one set of aligned apertures of the upper and lower members adapted to receive the first end portion of the strap such that the first end portion of the strap can be secured to the cylinder means, a second set of aligned apertures of the upper and lower members adapted to receive the second end portion of the strap such that the second end portion of the strap can be secured to the cylinder means.

13. An improved tamper-resistant container comprising:

a vial hving a side portion and a bottom plate member connected to a lower end portion of the side portion, an upper portion of the side portion defining a dispensing opening;

a vial closure member securable to the upper side portion of the vial to close off the dispensing opening;

detachable disc insert means disposable within the dispensing opening such as to allow the vial closure member to be secured to the vial; and connector means for securing the detachable disc insert means in the dispensing opening, the connector means comprising a stem element having a first end portion and an opposed second end portion, the first end portion connected to the vial such that the opposed second end portion is detachably connected to the detachable disc insert means, the connector means and the detachable disc insert means cooperating such that upon removal of the detachable disc insert means from the vial the opposed second end portion of the stem is detached to provide an indicator signal that the disc insert means has been previously removed.

14. The improved tamper-resistant container of claim 13 wherein the detachable disc insert means is provided with an aperture therein and wherein the connector means further comprises an enlarged breakaway tip portion formed on the opposed second end of the stem element, the top portion positionable through the aperture in the detachable disc insert means such that upon removal of the disc insert means from the opening in the container the tip portion is removed from the stem member.

15. The improved tamper-resistant container of claim 14 wherein the stem element is formed as an integral part of the vial.

16. The improved tamper-resistant container of claim 14 wherein the bottom plate member of the vial is provided with an aperture therein for receiving the first end portion of the stem member, and wherein the connector means further comprises a base member connected to the first end portion of the stem member such that upon positioning the stem member into the vial via the aperture in the bottom plate member, the base member is disposed substantially adjacent a portion of the bottom plate member defining the aperture therein.

17. An improved tamper-resistant container comprising:

a vial having a side portion and a bottom plate member connected to a lower end portion of the side portion, an upper portion of the side portion defining a dispensing opening;

a vial closure member securable to the upper side portion of the vial to close off the dispensing opening;

detachable disc insert means disposable within the dispensing opening such as to allow the vial closure member to be secured to the vial, the disc insert means comprising a substantially cylinder member having an upper member, a spatially disposed lower member and a side member interconnecting the upper and lower members so as to provide a cavity therebetween; and connector means for securing the detachable disc insert means in the dispensing opening, the connector means and the detachable disc insert means cooperating such that upon removal of the disc insert means from the vial at least a portion of the connector means is retained in the cavity of the disc insert means to provide an indicator signal that the disc insert means has been previously removed.

18. The improved tamper-resistant container of claim 17 wherein the upper member of the cylinder member is provided with a circumference substantially corresponding to the inside diameter of the dispensing opening in the vial and the lower member of the cylinder member is provided with a circumference less than the inside diameter of the dispensing opening such that the side member is tapered.

19. The improved tamper-resistant container of claim 18 wherein the connector means comprises a stem element having a first end portion and an opposed second end portion, the first end portion connectable to the bottom plate member of the vial and the second end portion connectable to the lower member of the cylinder member such that upon removal of the cylinder member the opposed second end portion of the stem member breaks away from the remainder of the stem element to provide the indicator signals.

20. The improved tamper-resistant container of claim 19 wherein the lower member of the cylinder member is provided with an aperture therein and wherein the opposed second end portion of the stem member comprises an enlarged, substantially conical shaped tip portion positionable through the aperture of the lower member of the cylinder member such that upon removal of the cylinder member from the dispensing opening of the vial the tip portion of the stem member breaks away from the remainder of the stem and is contained within the cylindrical member.

21. The improved tamper-resistant container of claim 17 wherein the disc removal means comprises a strap.

* * * * *

UNITED STATES PATENT AND TRADEMARK OFFICE

CERTIFICATE OF CORRECTION

PATENT NO. : 4,483,449

DATED : November 20, 1984

INVENTOR(S) : Marcus C. Jones

It is certified that error appears in the above-identified patent and that said Letters Patent is hereby corrected as shown below:

In Column 4, line 11, the numeral "46" should read --48--; in Column 7, line 11 the numeral "16" should read --116--; and in Column 10, line 21, the word "hving" should read --having--.

Signed and Sealed this

*Twenty-first* Day of *January 1986*

[SEAL]

*Attest:*

DONALD J. QUIGG

*Attesting Officer*

*Commissioner of Patents and Trademarks*